US011998069B2

(12) United States Patent
Young et al.

(10) Patent No.: US 11,998,069 B2
(45) **Date of Patent: *Jun. 4, 2024**

(54) GARMENT WITH REAR ACCESS SPACE

(71) Applicant: Spanx, LLC, Atlanta, GA (US)

(72) Inventors: Bethany Young, Salmon Arm (CA); Jolene Danielson, Atlanta, GA (US); Kelsey Smith, Atlanta, GA (US); Katie Paquet, North Vancouver (CA)

(73) Assignee: Spanx, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/739,676

(22) Filed: May 9, 2022

(65) Prior Publication Data

US 2023/0354927 A1 Nov. 9, 2023

(51) Int. Cl.
*A41D 13/00* (2006.01)
*A41D 13/02* (2006.01)

(52) U.S. Cl.
CPC ..... *A41D 13/02* (2013.01); *A41D 2400/44* (2013.01)

(58) Field of Classification Search
CPC ..... A41D 13/02; A41D 2400/44; A41D 2300/20; A41D 11/00
See application file for complete search history.

(56) References Cited

U.S. PATENT DOCUMENTS 1,202,578 A * 10/1916 Peterson ..... A41B 9/08 2/78.2
1,419,059 A * 6/1922 Klein ..... A41D 11/00 2/7
1,552,733 A * 9/1925 Rhoden ..... A41B 9/08 2/71
1,568,917 A * 1/1926 Peterson ..... A41B 9/08 2/73
1,691,790 A * 11/1928 Volker ..... A41B 9/08 2/71
1,871,086 A * 8/1932 Rutledge ..... A41B 9/08 D2/714
2,021,033 A * 11/1935 Thomas ..... A41B 9/08 D2/714
2,118,958 A * 5/1938 Watinsky ..... A41D 7/00 D2/735
2,290,370 A * 7/1942 Fox ..... A41B 1/04 2/115
2,442,803 A * 6/1948 Garson ..... A41C 3/08 450/33
2,532,375 A * 12/1950 Sider ..... A41C 3/08 450/33
2,535,018 A * 12/1950 Reid ..... A41D 7/00 2/67

(Continued)

*Primary Examiner* — Richale L Quinn

(74) *Attorney, Agent, or Firm* — Meunier Carlin & Curfman LLC

(57) ABSTRACT

The disclosed garments are designed to address the need for a one-piece garment with convenient restroom accessibility. The activewear garment disclosed herein has a rear access space that address the limitations of existing one-piece garments. The rear access space is located at a wearer's lower back and may be widened to an extended position to allow for easy restroom use. The rear access space solution provides the wearer with security and comfortability during normal use and prevents the need to remove the entire garment to use the restroom.

11 Claims, 7 Drawing Sheets

(56) References Cited

U.S. PATENT DOCUMENTS 2,849,717 A * 9/1958 Klotz ..... A41D 13/02 2/79
3,088,116 A * 5/1963 Simonoff ..... A41D 13/02 2/78.2
3,771,172 A * 11/1973 Barg ..... A41D 7/00 2/912
3,852,824 A * 12/1974 Grey ..... A41D 13/02 2/79
3,956,774 A * 5/1976 Spaulding ..... A41D 13/02 2/79
3,994,026 A * 11/1976 Sampey ..... A41D 13/02 D2/743
4,494,546 A * 1/1985 Steiman ..... A41D 7/00 450/8
4,535,480 A * 8/1985 Kunieda ..... A41D 13/02 2/79
5,014,356 A * 5/1991 Tomasi-Dubois ..... A41D 13/02 2/79
5,163,182 A * 11/1992 Fiveash ..... A41D 13/02 2/221
5,896,581 A * 4/1999 Wong ..... A41D 13/02 2/78.2
8,359,663 B2 * 1/2013 Blomkwist ..... A41B 13/08 2/78.2
8,425,275 B2 * 4/2013 Noel ..... A41B 9/08 450/131
9,044,052 B2 * 6/2015 Wong ..... A41D 1/22
9,198,467 B2 * 12/2015 Gordon ..... A41C 1/06
9,456,636 B2 * 10/2016 Blomberg ..... A41B 13/08
10,765,156 B2 * 9/2020 Myerscough ..... A41B 9/00
10,905,175 B1 * 2/2021 DiLorenzo ..... A41D 27/02
11,019,853 B2 * 6/2021 Drynan ..... A41B 9/002
D975,961 S * 1/2023 Waldman ..... D2/731
2010/0299797 A1 * 12/2010 Riehl ..... A41D 1/22 2/74
2013/0296763 A1 * 11/2013 Farrow ..... A61H 1/008 602/75
2014/0053314 A1 * 2/2014 Blomberg ..... A41B 13/08 2/80
2014/0317828 A1 * 10/2014 Holsinger ..... A41B 13/08 2/80
2017/0325516 A1 * 11/2017 Oborina ..... A41C 3/0007
2020/0155373 A1 * 5/2020 Tallman ..... A61F 13/49007
2021/0076752 A1 * 3/2021 Ceraolo ..... A41D 15/00
2022/0369729 A1 * 11/2022 Marquez ..... A41D 1/22

* cited by examiner

GARMENT WITH REAR ACCESS SPACE

BACKGROUND

This application relates to the field of active apparel or athleisure, and specifically to a one-piece garment with a rear opening for restroom access. Consumers are demanding high-performing one-piece activewear such as dresses, rompers, and bodysuits. One-piece activewear is fashionable and desirable for its simplicity in styling an outfit. Such garments are often form-fitting to accentuate or enhance a wearer's figure and to provide security and support during exercise or other athletic activities.

Existing one-piece garments, however, present problems when it comes time to use the restroom. Often, a wearer must partially, or even entirely, undress in order to use the restroom. This leaves the wearer feeling exposed, vulnerable, and unsupported—particularly where the one-piece garment is providing support to the wearer's breasts during wear. This is also a significant time barrier when the need to use the restroom is urgent. In addition, the need to remove the torso portion of a one-piece garment can make it difficult to reposition the garment after using the restroom. For example, a wearer may have difficulty repositioning or concealing removable breast cups, garment tape, or bra straps before exiting a restroom or stall. Moveable or detachable gussets may allow for restroom access, but the necessary opening(s) and attachments in the crotch area can cause wearers to feel exposed or conscious of their movement. Moveable and detachable gussets can further be difficult to pull to the side or detach during restroom use, and the gusset sizes and accompanying access spaces may not be inclusive to a variety of body types.

A need therefore exists for one-piece activewear garments with improved restroom access. Accordingly, a solution that addresses the above-mentioned shortcomings is desired and provided herein.

BRIEF SUMMARY

According to one aspect of the invention, there is provided a garment with rear access space comprising: a front upper panel, a front lower panel, a rear upper panel, and a rear lower panel, wherein the front lower panel and the rear lower panel at least partially define a crotch region and left and right leg spaces, the rear upper panel comprises a lower edge, the rear lower panel comprises an upper edge, at least a portion of the lower edge of the rear upper panel and at least a portion of the upper edge of the rear lower panel define a rear access space positioned at a wearer's lower back, and the upper edge of the rear lower panel is configured to be stretched to widen the rear access space.

According to another aspect of the invention, there is provided a garment with rear access space comprising: an outer layer and a liner, wherein the liner further comprises a front upper panel, a front lower panel, a rear upper panel, and a rear lower panel, the front lower panel and the rear lower panel at least partially define a crotch region and left and right leg spaces, the rear upper panel comprises a lower edge, and the rear lower panel comprises an upper edge, at least a portion of the lower edge of the rear upper panel and at least a portion of the upper edge of the rear lower panel define a rear access space positioned at a wearer's lower back, and the upper edge of the rear lower panel is configured to be stretched to widen the rear access space.

Methods of making these aspects are also discussed herein.

DETAILED DESCRIPTION

Figure 1:
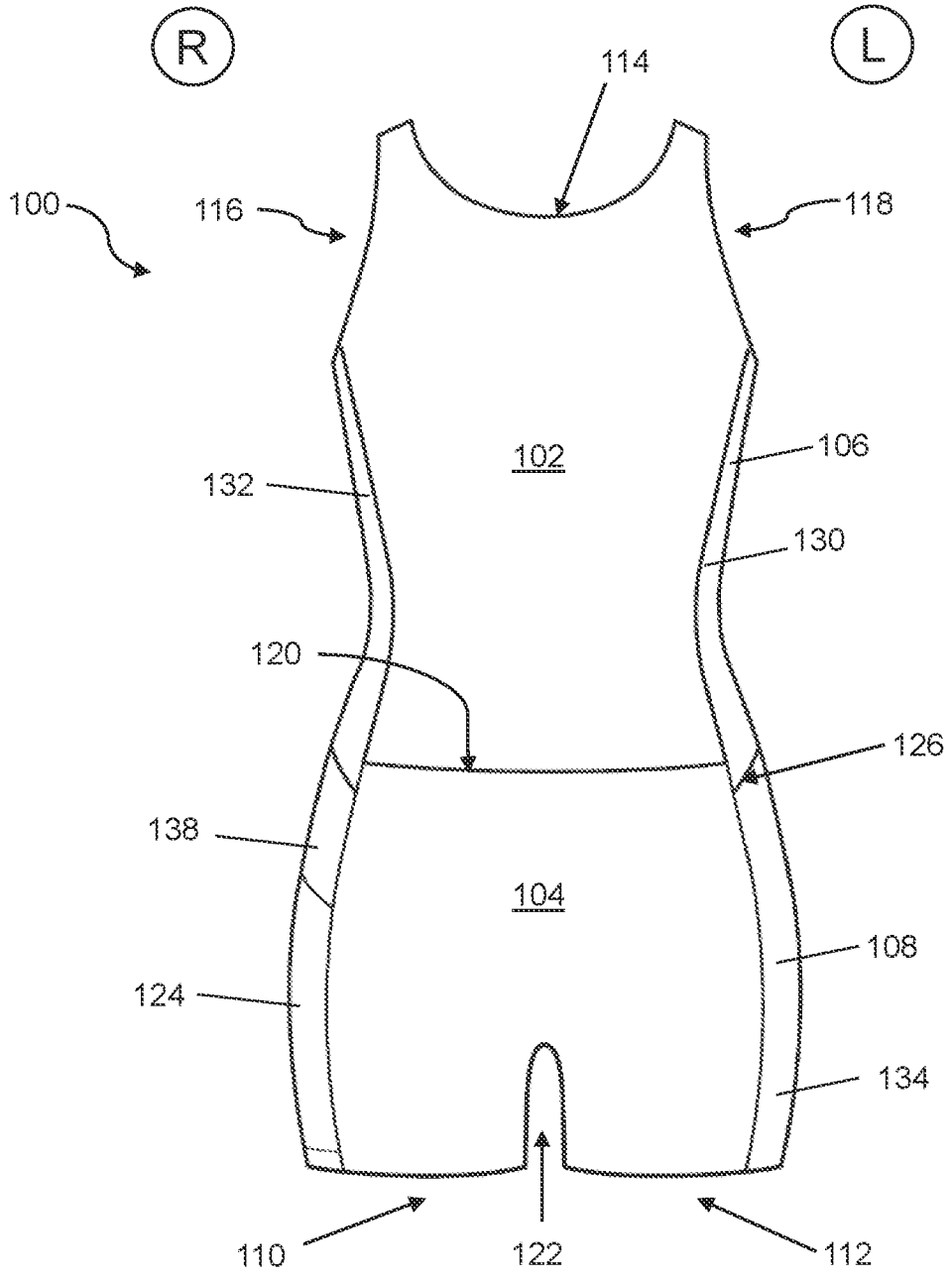
FIG. 1 is a front view illustrating a garment having a rear access space in accordance with an aspect of the invention.

The present invention can be understood more readily by reference to the following detailed description, examples, drawings, and claims, and their previous and following description. However, before the present garments, articles, systems, and/or methods are disclosed and described, it is to be understood that this disclosure is not limited to the specific or exemplary aspects of garments, articles, systems, and/or methods disclosed unless otherwise specified, as such can vary. Instead, the present disclosure is directed toward all novel and nonobvious features and aspects of the various disclosed aspects, alone and in various combinations and sub-combinations with one another. The disclosed methods, systems, and apparatus are not limited to any specific aspect, feature, or a combination thereof, nor do the disclosed methods, systems, and apparatus require that any one or more specific advantages be present or problems be solved.

The following description of the invention is provided as an enabling teaching of the invention in its best, currently known aspects. To this end, those skilled in the relevant art will recognize and appreciate that many changes can be made to the various aspects of the invention described herein while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Features, integers, characteristics, or groups described in conjunction with a particular aspect or example of the invention are to be understood to be applicable to any other aspect or example described herein unless incompatible therewith. All the features disclosed in this specification (including any accompanying claims, abstract, and drawings) and/or all of the steps of any method or process so disclosed may be combined in any combination, except combinations where at least some of such features and/or steps are mutually exclusive. The invention is not restricted to the details of any aspects. The invention extends to any novel one, or any novel combination, of the features disclosed in this specification (including any accompanying claims, abstract, and drawings), or to any novel one, or any novel combination, of the steps of any method or process so disclosed.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

As used herein, the terms "optional" or "optionally" mean that the subsequently described event or circumstance can or cannot occur and that the description includes instances where said event or circumstance occurs and instances where it does not.

It is appreciated that certain features of the disclosure, which are, for clarity, described in the context of separate aspects, can also be provided in combination in a single aspect. Conversely, various features of the disclosure, which are, for brevity, described in the context of a single aspect, can also be provided separately or in any suitable subcombination.

As used in the description and the appended claims, the singular forms "a," "an," and "the" include plural referents unless the context clearly dictates otherwise. Thus, for example, a reference to "a panel" includes two or more such panels, reference to "a band" includes two or more such bands and the like.

Ranges may be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint and independently of the other endpoint.

It is also to be understood that the terminology used herein is for the purpose of describing particular aspects only and is not intended to be limiting. As used in the specification and in the claims, the term "comprising" can include the aspects "consisting of" and "consisting essentially of" Unless defined otherwise, all technical and scientific terms used herein have the same meaning as commonly understood by one of ordinary skill in the art to which this invention belongs. In this specification and in the claims, which follow, reference will be made to a number of terms that shall be defined herein.

For the terms "for example" and "such as," and grammatical equivalences thereof, the phrase "and without limitation" is understood to follow unless explicitly stated otherwise.

It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present. Other words used to describe the relationship between elements or layers should be interpreted in a like fashion (e.g., "between" versus "directly between," "adjacent" versus "directly adjacent," "on" versus "directly on"). As used herein, the term "and/or" includes any and all combinations of one or more of the associated listed items.

It will be understood that, although the terms "first," "second," etc., may be used herein to describe various elements, components, regions, layers and/or sections. These elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of example aspects.

As used herein, the term "substantially" means that the subsequently described event or circumstance completely occurs or that the subsequently described event or circumstance generally, typically, or approximately occurs. Still further, the term "substantially" can in some aspects refer to at least about 80%, at least about 85%, at least about 90%, at least about 91%, at least about 92%, at least about 93%, at least about 94%, at least about 95%, at least about 96%, at least about 97%, at least about 98%, at least about 99%, or about 100% of the stated property, component, composition, or other condition for which substantially is used to characterize or otherwise quantify an amount.

While aspects of the present invention can be described and claimed in a particular statutory class, such as the system statutory class, this is for convenience only, and one of ordinary skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is in no way intended that an order be inferred in any respect. This holds for any possible non-express basis for interpretation, including matters of logic with respect to arrangement of steps or operational flow, plain meaning derived from grammatical organization or punctuation, or the number or type of aspects described in the specification.

The present invention may be understood more readily by reference to the following detailed description of various aspects of the invention and the examples included therein and to the Figures and their previous and following description.

This description below refers to certain aspects of the garment relative to other aspects of the garment or to the body of a wearer. As used herein, superior indicates a direction that is closer to the wearer's head. Inferior indicates a direction that is closer to the wearer's feet. Upward, upper, or uppermost indicates a superior direction or toward a wearer's head. Downward, lower, or lowermost indicates an inferior direction or toward a wearer's feet. The longitudinal direction refers to an axis extending between the superior and inferior edges of the garment or between the wearer's head and feet. Lateral indicates a positioning that is closer to the sides of the wearer. Medial indicates a positioning that is farther from the sides of the wearer. The terms right and left are in reference to a wearer's body. However, the terms left side view and right side view are in reference to the garment rather than a wearer's body.

There exists a need for one-piece garments that allow for convenient restroom access. Current one-piece garments such as dresses, rompers, and bodysuits, often do not provide any solution for consumers who wish to remain clothed when using the restroom. Some one-piece garments may include access holes or slits in the crotch area or even detachable gussets to allow for some restroom access; however, such gussets commonly are difficult to manage, provide too small of an access space, or cause wearers to feel exposed or insecure. The garment disclosed herein is designed to address the need for fashionable one-piece garments, particularly in the activewear industry, that provide a convenient and adequately sized access space for restroom use while further providing security when the wearer is not using the restroom.

In certain aspects, described herein is a garment having a rear access space. In some aspects, the garment includes a front upper panel, a front lower panel, a rear upper panel, and a rear lower panel. In some aspects, the garment has a crotch region as well as right and left leg spaces. In further aspects, the rear access space is positioned at a wearer's lower back and is defined by a lower edge of the rear upper panel and an upper edge of the rear lower panel. In still further aspects, the upper edge of the rear lower panel is configured to be stretched to widen the rear access space to an extended position such that a wearer may utilize the rear access space to use the restroom while otherwise remaining clothed. In still further aspects, the front upper panel, front lower panel, rear upper panel, and rear lower panel define a liner, and the garment further comprises an outer layer covering the liner. In some aspects, the garment includes at least one shoulder strap.

Figure 2:
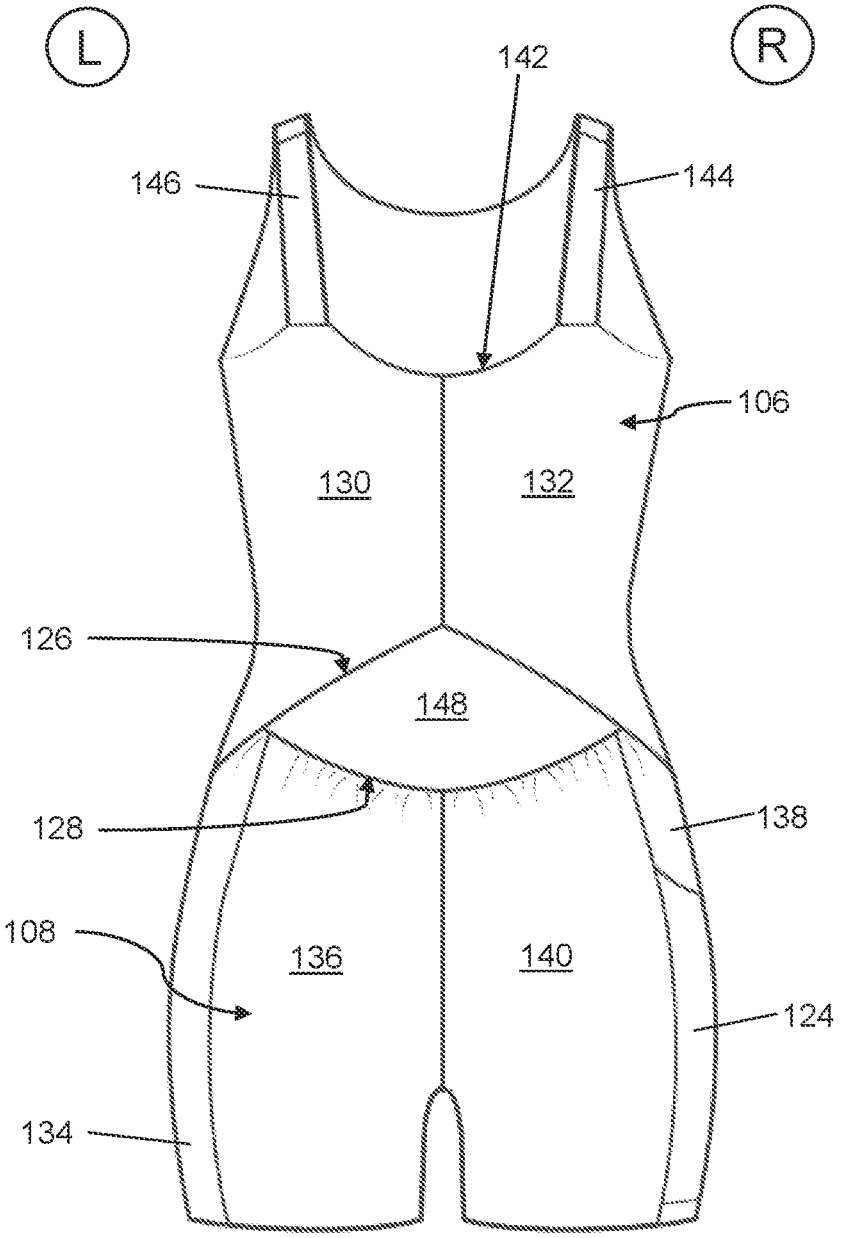
FIG. 2 is a rear view of the aspect of FIG. 1.
Figure 3:
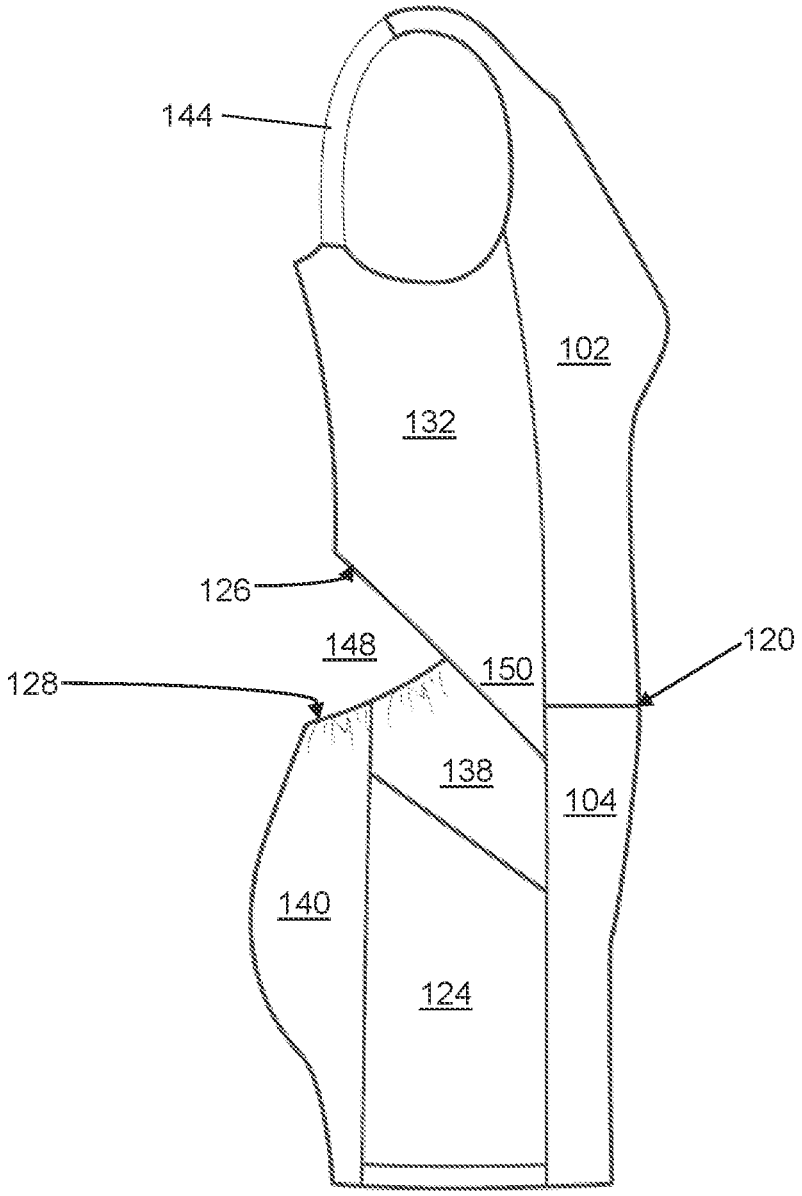
FIG. 3 is a left side view of the aspect of FIG. 1.
Figure 4:
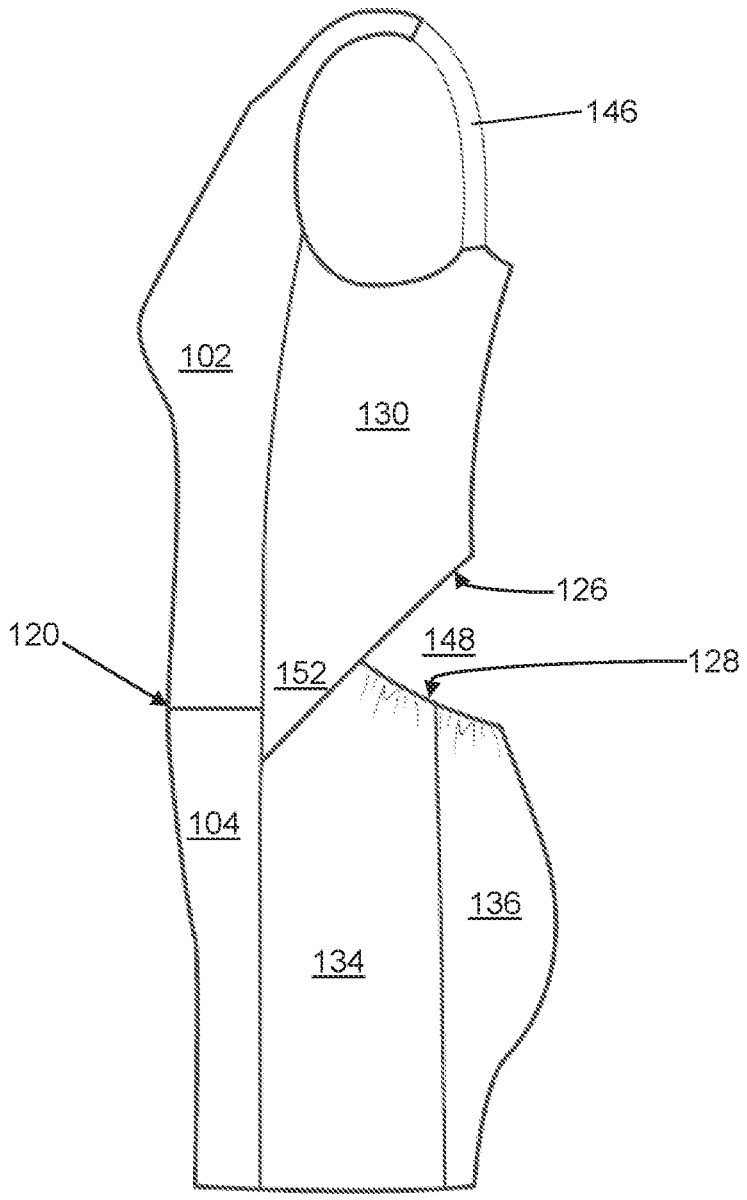
FIG. 4 is a right side view of the aspect of FIG. 1.
Figure 5:
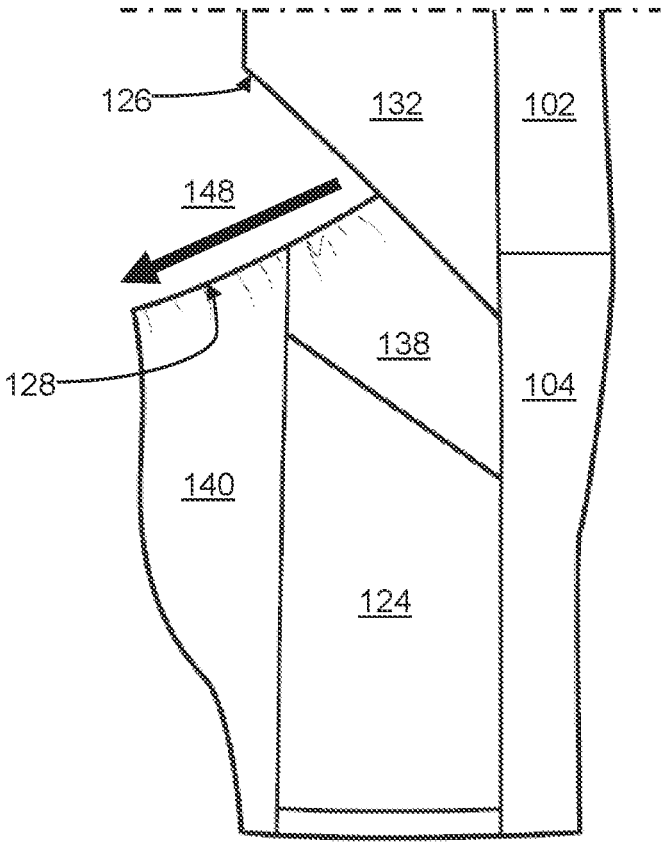
FIG. 5 is a left side detailed view of the aspect of FIG. 1 wherein the rear access space is in an extended position.
Figure 6:
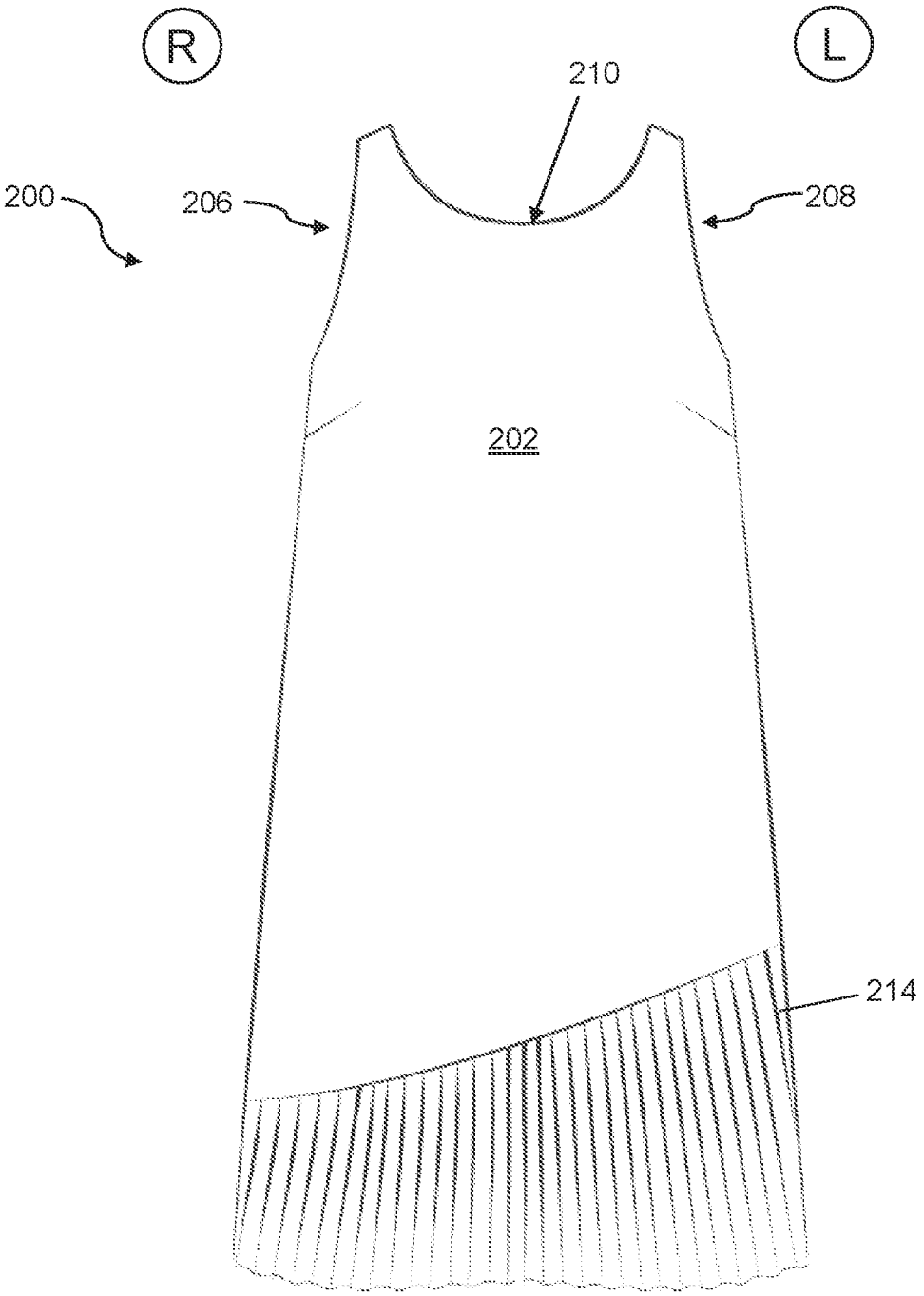
FIG. 6 is a front view illustrating a garment having a rear access space in accordance with another aspect of the invention.
Figure 7:
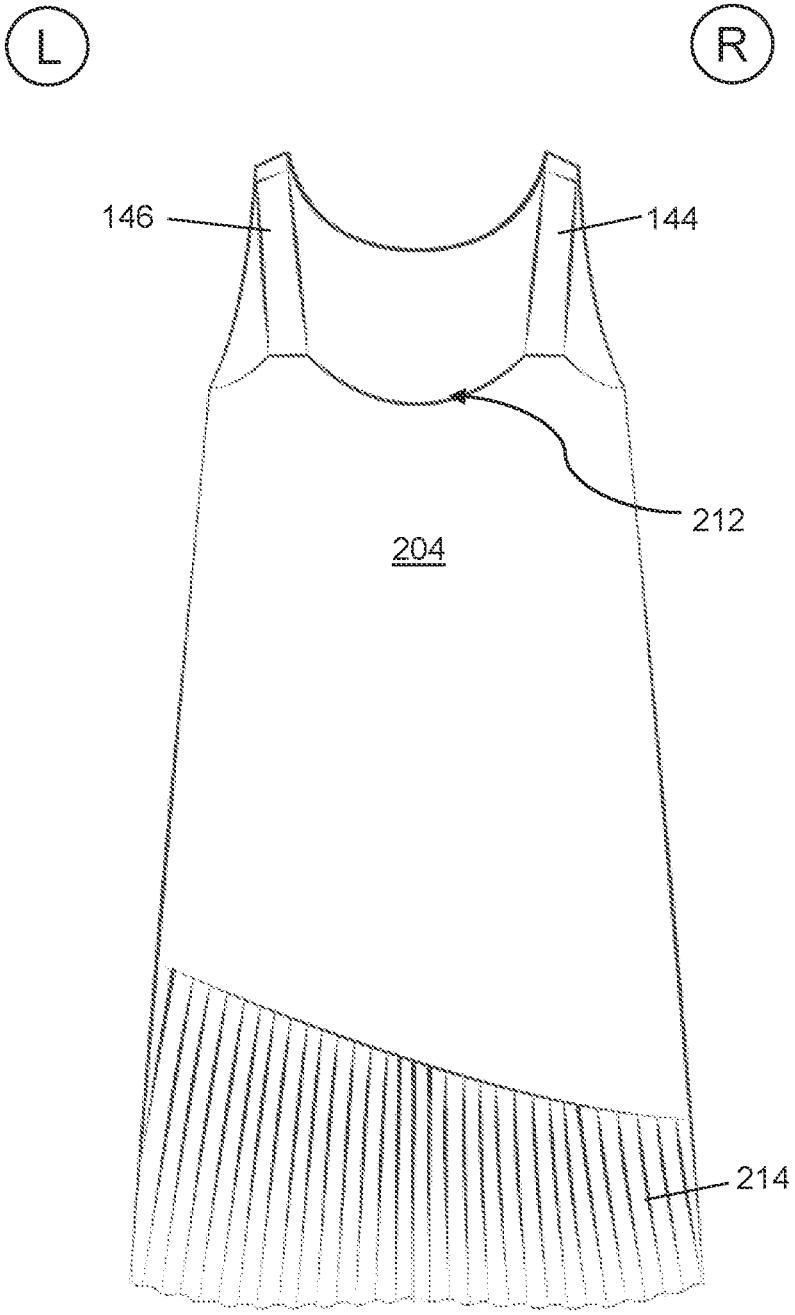
FIG. 7 is a rear view of the aspect of FIG. 6.

The accompanying drawings illustrate two aspects of the disclosed garment with a rear access space for convenient restroom use. FIG. 1 is a front view illustrating a bodysuit garment 100 having a rear access space 120 in accordance with one aspect of the invention. FIG. 2 is a rear view of the aspect of FIG. 1. FIG. 3 is a left side view of the aspect of FIG. 1. FIG. 4 is a right side view of the aspect of FIG. 1. FIG. 5 is a left side detailed view of the aspect of FIG. 1 wherein the rear access space is in an extended position. FIG. 6 is a front view illustrating a dress outer layer with bodysuit liner garment 200 having a rear access space 120 in accordance with another aspect of the invention. FIG. 7 is a rear view of the aspect of FIG. 6.

The bodysuit garment 100 includes a front upper panel 102, a front lower panel 104, a rear upper panel 106, and a rear lower panel 108. The rear upper panel 106 further comprises a left rear upper panel 130 and a right rear upper panel 132. The rear lower panel 108 further comprises a left lateral panel 134, a left medial panel 136, a right lateral panel 138, and a right medial panel 140. The front and rear lower panels 104, 108 define right and left leg spaces 110, 112 as well as a crotch region 122. The front upper panel 102 also defines a front neckline 114, and the rear upper panel 106 defines a rear neckline 142. The front and rear upper panels 102, 106 also define left and right arm spaces 116, 118. The left and right arm spaces 116, 118 are also further defined by right and left shoulder straps 144, 146. The bodysuit garment further comprises a front waistline 120 located at about the wearer's waistline and a pocket 124 attached to the right lateral panel 138. The rear upper panel 106 comprises a lower edge 126, and the rear lower panel 108 comprises an upper edge 128. The lower edge 126 of the rear upper panel 106 and the upper edge 128 of the rear lower panel 108 define a rear access space 148. The rear access space is configured to be widened to an extended position when the upper edge 128 of the rear lower panel 108 is stretched. The bodysuit garment 100 further comprises a right and left overlapping region 150, 152, defined by the areas to the right and left of the rear access space 148 where the rear upper panel 106 and rear lower panel 108 overlap.

The dress and bodysuit garment 200 includes an outer layer and a liner, the outer layer comprising a front outer panel 202 and a rear outer panel 204. The liner is understood to be the bodysuit garment 100. The outer layer is affixed to the liner at a front neckline 210, a rear neckline 212, and right and left arm spaces 206, 208. The outer layer is also affixed to the right and left shoulder straps 144, 146. The outer layer further comprises a lower edge 214, located at the inferior ends of the front outer panel 202 and rear outer panel 204. The lower edge 214 of the outer layer comprises a pleated material.

In certain aspects, the bodysuit garment, including the front upper and lower panels and the rear upper and lower panels, may be made from knitted or woven fabric comprising threads of any fiber known in the art and applicable to the desired uses. Specifically, the fiber type can comprise natural and/or synthetic fibers. Exemplary fiber types include, but are not limited to, cotton, nylon, viscose, elastane, polyester, wool, rayon, silk, linen, and hemp. The knitted or woven fabric(s) can be lightweight and/or breathable to provide for comfortability and style during exercise or athletic performance. Persons of ordinary skill in the art would readily recognize commercially available fabrics suitable for use in the bodysuit garments disclosed herein.

The outer layer may be made from knitted or woven fabric comprising threads of any fibers known in the art and applicable to the desired uses. Specifically, the fiber type can comprise natural and/or synthetic fibers. Exemplary fiber types include, but are not limited to, cotton, nylon, viscose, elastane, polyester, wool, rayon, silk, linen, and hemp. The knitted or woven fabric(s) can be lightweight to provide for comfortability, style, and breathability. The knitted or woven fabric(s) of the outer layer can comprise the same or different threads as the threads of the knitted or woven fabric(s) of the bodysuit garment. Persons of ordinary skill in the art would readily recognize commercially available fabrics suitable for use in the outer layer and the dress and bodysuit liner garments disclosed herein.

In some aspects, polyester, nylon, cotton, rayon, and/or elastane can be present in any ratio to provide for the desired level of compressibility, elasticity, and stretchability. It is understood if the fiber comprises two or more polymers, these polymers can be present in any ratio that is needed to achieve the desired result. For example, if two or more polymers are present in the fiber, a first polymer can be present in the range from greater than 0 wt % to less than 100 wt %, including exemplary values of about 1 wt %, about 5 wt %, about 10 wt %, about wt %, about 30 wt %, about 40 wt %, about 50 wt %, about 60 wt %, about 70 wt %, about 80 wt %, about 90 wt %, and about 99.9 wt %. In still further aspects a second polymer can also be present in any amount in the range from greater than 0 wt % to less than 100 wt %, including exemplary values of about 1 wt %, about 5 wt %, about 10 wt %, about 20 wt %, about 30 wt %, about 40 wt %, about 50 wt %, about 60 wt %, about 70 wt %, about 80 wt %, about 90 wt %, and about 99.9 wt %. In some exemplary and unlimiting aspects, the bodysuit garment can comprise about 93% polyester and 7% elastane.

The bodysuit garment is illustrated by the figures herein as a form-fitting bodysuit with short legs. However, the length of the legs and sleeves may be varied depending on desired use. The outer layer is illustrated by the figures herein as a dress. However, it could alternatively take the form of a romper with varying lengths of leg spaces or a skirt. In some aspects, the bodysuit garment is configured to fit snug to the wearer's body to provide compressibility and highlight the wearer's features.

The outer layer can be in the style of dressy, casual, or activewear, or any combination thereof. As shown in FIGS. 7 and 8, the lower edge of the outer layer may comprise a pleated material. The outer layer may be fixedly or removably attached to the bodysuit garment, wherein the bodysuit garment functions as a liner. Conventional sewing methods may be used to attach the outer layer to the bodysuit garment. The outer layer may be partially attached to the bodysuit garment at one or more locations superior to the rear access space but otherwise unattached to the bodysuit garment. This configuration allows for the outer layer to cover the rear access space during regular wear but also allows for the outer layer to be lifted out of the way to expose the rear access space during restroom use. In some aspects, a bottom edge of the outer layer extends to or beyond a bottom edge of the liner. In other aspects, the bottom edge of any of the outer layer, the bodysuit garment, or the liner may be a free cut edge.

In certain aspects, a rear access space is defined by an upper edge of the rear lower panel and a lower edge of the rear upper panel. In some aspects, the rear access space is positioned at a wearer's lower back. In some aspects, the upper and lower edges are completely unattached to each other. In some aspects, the upper edge of the rear lower panel extends inferiorly in a medial direction. In other aspects, the lower edge of the at least one rear upper panel extends superiorly in a medial direction. In still further aspects, the rear access space defines a shape selected from the group consisting of a rectangle, a half-oval, an oval, a half-circle, a circle, a triangle, or a diamond. During regular wear, the upper edge of the rear lower panel is substantially aligned above the wearer's buttocks. During restroom use, the upper edge of the rear lower panel may be stretched to widen the rear access space to an extended position below the wearer's buttocks. In some aspects, the upper edge of the rear lower panel has a percent elongation of about 30-100%. In other aspects, the percent elongation is about 30-80%, 30-70%, 30-60%, or 30-50%.

In certain aspects, a left end of the lower edge of the rear upper panel is affixed to a right edge of the front lower panel, and a right end of the lower edge of the rear upper panel is affixed to a left edge of the front lower panel. In other aspects, a left end of the upper edge of the rear lower panel is affixed to a right edge of the front upper panel, and a right end of the upper edge of the rear lower panel is affixed to a right edge of front upper panel. Conventional sewing methods may be used to affix the ends to the edges.

In certain aspects, the upper edge of the rear lower panel further comprises an elastic band. The elastic band may be positioned on and fixedly attached to a portion of the interior of the rear lower panel at the upper edge. The elastic band provides additional support and elasticity to the upper edge of the rear lower panel. In some aspects, the rear lower panel further comprises ruching along its upper edge. The ruching may be gathered by the elastic band or by a conventional seam. The ruching allows for additional stretchability of the upper edge of the rear lower panel during restroom use.

In still further aspects, the left rear upper panel partially overlaps the left lateral panel of the rear lower panel, defining a left overlapping region, and the right rear upper panel partially overlaps the right lateral panel of the rear lower panel, defining a right overlapping region. In some aspects, the length of each of the left and right overlapping regions in a longitudinal direction is about 1-2 inches. In other aspects, the length of the left and right overlapping regions in a longitudinal direction is about 1.25-1.75 inches. In some aspects, the left and right upper rear panels are positioned external to the left and right lateral panels of the rear lower panel, and vice versa.

In some aspects, the left rear upper panel and the left lateral panel of the rear lower panel are unattached to each other in the left overlapping region. In other aspects, the right rear upper panel and the right lateral panel of the rear lower panel are unattached to each other in the right overlapping region. In aspects where the left and right overlapping regions are unattached, the panels may move freely against each other, which allows for additional stretchability and elongation of the upper edge of the rear lower panel.

In certain aspects, the garment can be strapless or comprise one or a pair of shoulder straps. In further aspects, the bodysuit garment comprises right and left shoulder straps. In some aspects, the right and left shoulder straps are configured to extend across a wearer's right and left shoulders, respectively, from the front of the garment to the rear. It is understood that the right and left shoulder straps can be positioned on the wearer's back in any pattern. In some aspects, the right and left shoulder straps extend straight across the wearer's shoulders without overlapping with or connecting to each other. While in other exemplary and unlimiting aspects, the right and left shoulder straps can overlap to form a crisscross pattern, may be temporarily fastened to each other to form an X pattern, or may be in a racerback shape. While in other aspects, the right and left shoulder straps are configured to extend from the front of the garment and around the wearer's neck in a halter style. In some aspects, the straps may have less elasticity than the rest of the garment to provide extra support to the shoulders.

In certain aspects, the bodysuit garment can comprise at least one pocket. In some aspects, a pocket is positioned on the bodysuit garment below a wearer's hip. One or more pockets may be affixed to the rear lower panel using conventional methods such as cutting and sewing. In further aspects, a pocket may be affixed to one of the left lateral panel, a left medial panel, right lateral panel, or right medial panel. The pocket may be made of the same or different material than the bodysuit garment or outer layer. The pocket may be sized according to its desired purpose. In some aspects, the pocket may be sized to hold a house key, while in other aspects, the pocket may be sized to hold a conventional smartphone or wallet.

In certain aspects, the bodysuit garment can comprise built-in breast support. In some aspects, the built-in breast support is a shelf bra affixed to the interior of the bodysuit garment. In further aspects, the built-in breast support comprises left and right brassiere cups that may be fixedly attached or removable. The built-in breast support may be made of the same or different material than the bodysuit garment or outer layer.

In certain aspects, the front and rear necklines of the bodysuit garment and the outer layer may be the same or different size or shape. The necklines may be in a V-shape or a U-shape. The front neckline may extend below the rear neckline in an inferior direction, or vice versa. The front neckline of the bodysuit garment may extend below the front neckline of the outer layer in an inferior direction, or vice versa. The rear neckline of the bodysuit garment may extend below the rear neckline of the outer layer in an inferior direction, or vice versa.

In some aspects, the front and rear necklines of the bodysuit garment and the outer layer align. In still further aspects, the bodysuit garment is attached to the outer layer by at least partially attaching the front neckline of the bodysuit garment to the front neckline of the outer layer and/or by at least partially attaching the rear neckline of the bodysuit garment to the rear neckline of the outer layer. The necklines may be fixedly attached by conventional sewing methods.

In certain aspects, the right and left arm spaces of the bodysuit garment and the outer layer may be the same or different size or shape. In some aspects, the garment includes sleeves attached to the arm spaces of the outer layer. The sleeves may be any style or length, including short, three-quarter, and long sleeve.

In other aspects, the garment is sleeveless, and the right and left arm spaces of the bodysuit garment and the outer layer align. In still further aspects, the bodysuit garment is attached to the outer layer by at least partially attaching the right arm space of the bodysuit garment to the right arm space of the outer layer and/or by at least partially attaching the left arm space of the bodysuit garment to the left arm space of the outer layer. The arm spaces may be fixedly attached by conventional sewing methods.

Methods of making a garment are also disclosed herein. In some aspects, the method of making a garment comprises providing a front upper panel, a front lower panel, a rear upper panel, a rear lower panel, fixedly attaching the front lower panel to the rear lower panel to define a crotch region and left and right leg spaces, fixedly attaching the front lower panel to the front upper panel at a front waistline, fixedly attaching the rear upper panel to the front upper panel, and leaving an upper edge of the rear lower panel and a lower edge of the rear upper panel unattached to any part of the garment. In some aspects, the method further comprises fixedly attaching a left end of the lower edge of the rear upper panel to a right edge of the front lower panel, and fixedly attaching a right end of the lower edge of the rear upper panel to a left edge of the front lower panel. In some aspects, the method comprises fixedly attaching a left end of the upper edge of the rear lower panel to a right edge of the front upper panel, and fixedly attaching a right end of the upper edge of the rear lower panel to a left edge of the front lower panel. In still further aspects, the method comprises fixedly attaching an elastic band to the upper edge of the rear lower panel. In further aspects, the method comprises fixedly attaching at least a portion of an upper edge of the rear upper panel to a first distal edge of each of left and right shoulder straps, and fixedly attaching at least a portion of an upper edge of the front upper panel is unreleasably coupled to a second distal edge of each of the left and right shoulder straps.

In some aspects, the method of making a garment comprises providing an outer layer, providing a bodysuit garment liner, wherein the liner further comprises a front upper panel, a front lower panel, a rear upper panel, a rear lower panel, fixedly attaching the front lower panel to the rear lower panel to define a crotch region and left and right leg spaces, fixedly attaching the front lower panel to the front upper panel at a front waistline, fixedly attaching the rear upper panel to the front upper panel, and leaving an upper edge of the rear lower panel and a lower edge of the rear upper panel unattached to any part of the garment. In some aspects, the method further comprises fixedly attaching a left end of the lower edge of the rear upper panel to a right edge of the front lower panel, and fixedly attaching a right end of the lower edge of the rear upper panel to a left edge of the front lower panel. The method may also comprise fixedly attaching a left end of the upper edge of the rear lower panel to a right edge of the front upper panel, and fixedly attaching a right end of the upper edge of the rear lower panel to a left edge of the front lower panel. An elastic band may be fixedly attached to the upper edge of the rear lower panel. Further, the method may comprise providing left and right shoulder straps, fixedly attaching at least a portion of an upper edge of the rear upper panel of the liner and at least a portion of an upper edge of the rear outer layer to a first distal edge of each of the left and right shoulder straps, and fixedly attaching at least a portion of an upper edge of the front upper panel of the liner and at least a portion of an upper edge of the front outer layer to a second distal edge of each of the left and right shoulder straps.

The methods disclosed herein may further comprise fixedly attached a pocket or sleeves to the garment. Conventional cut and sew methods may be used to carry out the methods described herein. The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. A garment, comprising:

a front upper panel;

a front lower panel;

a rear upper panel;

a rear lower panel;

wherein the front lower panel and the rear lower panel at least partially define a crotch region and left and right leg spaces;

wherein the rear upper panel comprises a lower edge, and the rear lower panel comprises an upper edge, wherein at least a portion of the lower edge of the rear upper panel and at least a portion of the upper edge of the rear lower panel define a rear access space positioned at a wearer's lower back; and wherein the upper edge of the rear lower panel is configured to be stretched to widen the rear access space;

wherein the upper edge of the rear lower panel extends inferiorly in a medial direction;

wherein the front upper panel and front lower panel each further comprise a left edge and a right edge;

wherein the lower edge of the rear upper panel and the upper edge of the rear lower panel each comprises a left end and a right end;

wherein the left end of the lower edge of the rear upper panel is affixed to the right edge of the front lower panel, and the right end of the lower edge of the rear upper panel is affixed to the left edge of the front lower panel;

wherein the left end of the upper edge of the rear lower panel is affixed to the right edge of the front upper panel, and the right end of the upper edge of the rear lower panel is affixed to the left edge of the front upper panel;

wherein the rear upper panel further comprises a left rear upper panel and a right rear upper panel;

wherein the rear lower panel further comprises a left lateral panel, a left medial panel, a right lateral panel, and a right medial panel;

wherein the left rear upper panel partially overlaps the left lateral panel of the rear lower panel, defining a left overlapping region; and wherein the right rear upper panel partially overlaps the right lateral panel of the rear lower panel, defining a right overlapping region.

2. The garment of claim 1, wherein the lower edge of the rear upper panel extends superiorly in a medial direction.

3. The garment of claim 2, wherein the rear access space defines a shape selected from the group consisting of a rectangle, a half-oval, an oval, a half-circle, a circle, a triangle, or a diamond.

4. The garment of claim 1, wherein the garment further comprises an elastic band positioned along the upper edge of the rear lower panel.

5. The garment of claim 4, wherein the upper edge of the rear lower panel has a maximum percent elongation of about 30-100%.

6. The garment of claim 1, wherein the length of each of the left and right overlapping regions in a longitudinal direction is about 1-2 inches.

7. The garment of claim 1, wherein the garment further comprises at least one pocket.

8. The garment of claim 7, wherein the at least one pocket is configured to cover at least a portion of the right lateral panel of the rear lower panel.

9. The garment of claim 1, wherein the garment further comprises left and right shoulder straps configured to extend across a wearer's shoulders.

10. The garment of claim 9, wherein at least a portion of an upper edge of the rear upper panel is unreleasably coupled to a first distal edge of each of the left and right shoulder straps, and at least a portion of an upper edge of the front upper panel is unreleasably coupled to a second distal edge of each of the left and right shoulder straps.

11. The garment of claim 10, wherein at least a portion of the upper edge of the front upper panel defines a front neckline, wherein the front neckline is a U-shape or a V-shape.

* * * * *